US008745895B2

(12) United States Patent
Sokolowski et al.

(10) Patent No.: US 8,745,895 B2
(45) Date of Patent: Jun. 10, 2014

(54) ARTICLE OF FOOTWEAR HAVING A FLAT KNIT UPPER CONSTRUCTION OR OTHER UPPER CONSTRUCTION

(75) Inventors: Susan L. Sokolowski, Portland, OR (US); Bhupesh Dua, Portland, OR (US); Edward Nathaniel Thomas, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/490,718

(22) Filed: Jun. 7, 2012

(65) Prior Publication Data

US 2012/0240429 A1 Sep. 27, 2012

Related U.S. Application Data

(62) Division of application No. 11/558,501, filed on Nov. 10, 2006, now Pat. No. 8,225,530.

(51) Int. Cl.

| | |
|---|---|
| ***A43C 11/08*** | (2006.01) |
| ***A43B 1/04*** | (2006.01) |
| ***A43B 23/02*** | (2006.01) |
| ***A43B 23/04*** | (2006.01) |
| ***A43C 11/14*** | (2006.01) |
| ***D04B 1/24*** | (2006.01) |

(52) U.S. Cl.

CPC . *A43B 1/04* (2013.01); *A43B 23/02* (2013.01); *A43B 23/042* (2013.01); *A43C 11/1493* (2013.01); *D04B 1/24* (2013.01)

USPC ..... 36/50.1; 36/89; 36/9 R; 36/7.1 R

(58) Field of Classification Search

CPC ..... A43B 1/04; A43B 23/02; A43B 23/04; A43B 23/042; A43B 3/106; A43C 11/1493; A41B 11/00; D04B 1/24

USPC ..... 36/50.1, 89, 9 R, 7.1 R, 11.5; 2/239

See application file for complete search history.

(56) References Cited

U.S. PATENT DOCUMENTS 1,910,251 A 5/1933 Joha
1,920,943 A * 8/1933 Thompson ..... 2/240

(Continued)

FOREIGN PATENT DOCUMENTS

CN 2107150 U 6/1992
CN 1411762 A 4/2003

(Continued)

OTHER PUBLICATIONS

International Search Report, mailed Mar. 14, 2008, in the International Patent Application No. PCT/US2007/023245.

International Preliminary Report on Patentability, mailed May 22, 2009, in the International Patent Application No. PCT/US2007/023245.

Office Action issued Nov. 11, 2010, in Chinese Patent Application No. 200780045587.6 and English language translation thereof.

Office Action issued Oct. 17, 2011, in Japanese Patent Application No. 2009-536262 and English language translation thereof.

Office Action issued Jan. 11, 2012, in European Patent Application No. 07839933.4.

(Continued)

*Primary Examiner* — Ted Kavanaugh
(74) *Attorney, Agent, or Firm* — Plumsea Law Group, LLC

(57) ABSTRACT

An article of footwear may include an upper with a knitted element formed through a flat knitting process. In one configuration, the knitted element has an area with a first layer and a second layer at least partially coextensive with the first layer. The first layer is formed of unitary construction with the second layer, and the second layer is joined to the first layer at opposite sides of the second layer. In another configuration, a knitted element for footwear includes a foot-receiving portion and one or more straps formed of unitary construction with the foot-receiving portion. The foot-receiving portion defines a void for receiving the foot, and the strap(s) extend outward from sides of the foot-receiving portion.

17 Claims, 18 Drawing Sheets

(56) References Cited

U.S. PATENT DOCUMENTS

| | | | | |
|---|---|---|---|---|
| 2,047,724 | A | | 7/1936 | Zuckerman |
| 2,147,197 | A | | 2/1939 | Glidden |
| 2,260,138 | A | | 10/1941 | Feinberg |
| 2,314,098 | A | | 3/1943 | McDonald |
| 2,330,199 | A | | 9/1943 | Basch |
| 2,343,390 | A | | 3/1944 | Ushakoff |
| 2,376,339 | A | | 5/1945 | Yandell |
| 2,440,393 | A | | 4/1948 | Clark |
| 2,569,764 | A | | 10/1951 | Jonas |
| 2,608,078 | A | | 8/1952 | Anderson |
| 2,641,004 | A | | 6/1953 | Whiting et al. |
| 3,402,323 | A | | 9/1968 | Longstreth |
| 3,503,077 | A | | 3/1970 | Connelly |
| 3,583,081 | A | | 6/1971 | Hayashi |
| 3,603,006 | A | | 9/1971 | Davenport et al. |
| 3,640,006 | A | * | 2/1972 | Kendrick ..... 36/8.1 |
| 4,010,558 | A | | 3/1977 | Slusher |
| 4,150,498 | A | | 4/1979 | Palmer |
| 4,277,897 | A | | 7/1981 | O'Connell |
| 4,447,967 | A | | 5/1984 | Zaino |
| 4,750,339 | A | | 6/1988 | Simpson et al. |
| 4,756,098 | A | | 7/1988 | Boggia |
| 4,785,558 | A | | 11/1988 | Shiomura |
| 4,813,158 | A | | 3/1989 | Brown |
| 4,852,272 | A | | 8/1989 | Chilewich et al. |
| 5,257,969 | A | | 11/1993 | Mance |
| 5,271,130 | A | | 12/1993 | Batra |
| D346,686 | S | | 5/1994 | Hatfield |
| 5,345,638 | A | | 9/1994 | Nishida |
| 5,353,524 | A | | 10/1994 | Brier |
| 5,377,430 | A | | 1/1995 | Hatfield et al. |
| 5,682,687 | A | | 11/1997 | Arai |
| 5,996,258 | A | | 12/1999 | Simmons |
| 6,333,105 | B1 | | 12/2001 | Tanaka et al. |
| 6,393,620 | B2 | | 5/2002 | Hatch et al. |
| 6,931,762 | B1 | | 8/2005 | Dua |
| 7,016,867 | B2 | | 3/2006 | Lyden |
| 7,080,466 | B2 | | 7/2006 | Fischbein |
| 7,082,703 | B2 | | 8/2006 | Greene et al. |
| 7,107,235 | B2 | | 9/2006 | Lyden |
| 7,552,483 | B2 | * | 6/2009 | Turner ..... 2/239 |
| 8,225,530 | B2 | * | 7/2012 | Sokolowski et al. ..... 36/9 R |
| 2002/0000002 | A1 | | 1/2002 | Hatch et al. |
| 2002/0148258 | A1 | | 10/2002 | Cole et al. |
| 2005/0193592 | A1 | | 9/2005 | Dua et al. |
| 2006/0265828 | A1 | | 11/2006 | Mallatt et al. |

FOREIGN PATENT DOCUMENTS

| | | | |
|---|---|---|---|
| EP | 0448714 | | 10/1991 |
| EP | 1233091 | | 8/2002 |
| GB | 480266 | A | 2/1938 |
| GB | 538865 | | 8/1941 |
| GB | 1603487 | | 11/1981 |
| JP | 2033608 | U | 3/1990 |
| JP | H06113905 | | 4/1994 |
| JP | 3014857 | U | 6/1995 |
| JP | 10000103 | A | 1/1998 |
| JP | 2005234 | A | 1/2005 |
| WO | 9003744 | | 4/1990 |
| WO | 0032861 | | 6/2000 |
| WO | 0231247 | | 4/2002 |

OTHER PUBLICATIONS

Office Action issued Feb. 9, 2012, in Japanese Patent Application No. 2009-536262 and English language translation thereof.

Excerpt of Hannelore Eberle et al., Clothing Technology (Third English ed., Beuth-Verlag GmnH 2002) (book cover and back; pp. 2-3, 83).

European Extended Search Report, issued Apr. 17, 2013. in corresponding European Patent Application No. 13153966.0.

* cited by examiner

ARTICLE OF FOOTWEAR HAVING A FLAT KNIT UPPER CONSTRUCTION OR OTHER UPPER CONSTRUCTION

RELATED APPLICATION DATA

The present patent application is a divisional of U.S. patent application Ser. No. 11/558,501, filed Nov. 10, 2006, entitled "Article of Footwear Having a Flat Knit Upper Construction or Other Upper Construction" and naming Susan Sokolowski, et al. as inventors, which application is incorporated in its entirety herein by reference.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces, the sole structure may provide traction and control foot motions, such as pronation. Accordingly, the upper and the sole structure operate cooperatively to provide a comfortable structure that is suited for a wide variety of ambulatory activities, such as walking and running The general features and configuration of the conventional upper are discussed in greater detail below.

The upper forms a void on the interior of the footwear for receiving the foot. The void has the general shape of the foot, and access to the void is provided by an ankle opening. Accordingly, the upper extends over the instep and toe areas of the foot, along the medial and lateral sides of the foot, and around the heel area of the foot. A lacing system is often incorporated into the upper to selectively increase the size of the ankle opening and permit the wearer to modify certain dimensions of the upper to accommodate feet with varying proportions. In addition, the upper may include a tongue that extends under the lacing system and a heel counter to limit movement of the heel.

The materials forming the upper may be selected based upon the properties of wear-resistance, flexibility, stretchability, and air-permeability, for example. With regard to the exterior layer, the toe area and the heel area may be formed of leather, synthetic leather, or a rubber material to impart a relatively high degree of wear-resistance. Leather, synthetic leather, and rubber materials, however, may not exhibit the desired degree of flexibility and air-permeability. Accordingly, various other areas of the exterior layer of the upper may be formed from a synthetic or natural textile material. The exterior layer of the upper may be formed, therefore, from numerous material elements that each impart different properties to specific portions of the upper.

The intermediate layer of the upper may be formed from a lightweight polymer foam material that provides cushioning. Similarly, the interior layer of the upper may be formed of a moisture-wicking textile that removes perspiration from the area immediately surrounding the foot. In some articles of athletic footwear, the various layers may be joined with an adhesive, and stitching may be utilized to join elements within a single layer or to reinforce specific areas of the upper.

Although the materials selected for the upper vary significantly, textile materials often form at least a portion of the exterior layer and interior layer. A textile may be defined as a structure manufactured from fibers, filaments, or yarns characterized by flexibility, fineness, and a high ratio of length to thickness. Textiles generally fall into two categories. The first category includes textiles produced directly from webs of filaments or fibers by randomly interlocking to construct non-woven fabrics and felts. The second category includes textiles formed through a mechanical manipulation of yarn (e.g., by interlacing or interlooping), thereby producing a woven fabric or a knit fabric, for example.

Yarn is the raw material utilized to form textiles in the second category. In general, yarn is defined as an assembly having a substantial length and relatively small cross-section that is formed of at least one filament or a plurality of fibers. Fibers have a relatively short length and require spinning or twisting processes to produce a yarn of suitable length for use in textiles. Common examples of fibers are cotton and wool. Filaments, however, have an indefinite length and may merely be combined with other filaments to produce a yarn suitable for use in textiles. Modern filaments include a plurality of synthetic materials such as rayon, nylon, polyester, and polyacrylic, with silk being the primary, naturally-occurring exception. Yarn may be formed of a single filament, which is conventionally referred to as a "monofilament yarn," or a plurality of individual filaments grouped together. Yarn may also include separate filaments formed of different materials, or the yarn may include filaments that are each formed of two or more different materials. Similar concepts also apply to yarns formed from fibers. Accordingly, yarns may have a variety of configurations that generally conform to the definition provided above.

The various techniques for mechanically manipulating yarn into a textile include interweaving, intertwining and twisting, and interlooping. Interweaving is the intersection of two yarns that cross and interweave at right angles to each other. The yarns utilized in interweaving are conventionally referred to as "warp" and "weft." Intertwining and twisting encompasses procedures such as braiding and knotting where yarns intertwine with each other to form a textile. Interlooping involves the formation of a plurality of columns of intermeshed loops, with knitting being the most common method of interlooping.

The textiles utilized in footwear uppers generally provide a lightweight, air-permeable structure that is flexible and comfortably receives the foot. In order to impart other properties to the footwear, including durability and stretch-resistance, additional materials are commonly combined with the textile, including leather, synthetic leather, or rubber, for example. With regard to durability, U.S. Pat. No. 4,447,967 to Zaino discloses an upper formed of a textile material that has a polymer material injected into specific zones to reinforce the zones against abrasion or other forms of wear. Regarding stretch resistance, U.S. Pat. No. 4,813,158 to Brown and U.S. Pat. No. 4,756,098 to Boggia both disclose a substantially inextensible material that is secured to the upper, thereby limiting the degree of stretch in specific portions of the upper. U.S. Patent Publication No. 2006-0048413 describes, inter alia, a rubber/foam web sandwiched between two textile structures to provide support, and this structure also allows for regional breathability, stretchability, and durability.

SUMMARY

One example structure according to this invention relates to an article of footwear having an upper and a sole structure secured to the upper. The upper includes a knitted element formed from at least one mechanically manipulated yarn. The knitted element of this example structure has an area with a first layer and a coextensive second layer. The first layer is formed as a unitary construction with the second layer, and the second layer is joined to the first layer at opposite sides of the second layer.

Another example aspect of the invention relates to a method of manufacturing an article of footwear. The method includes steps of flat knitting a textile element and incorporating the textile element into the article of footwear. The step of flat knitting may include forming an area of the textile element with a first layer and a coextensive second layer. The two layers may be utilized to form a channel, for example. In some configurations, the step of flat knitting may include forming a first area and a second area, with one or both of a stitch type and a yarn type of the first area being different than a stitch type and a yarn type of the second area.

Yet another example structure according to this invention relates to an article of footwear having a knitted element that includes a foot-receiving portion and one or more straps formed of unitary construction with the foot-receiving portion. The foot-receiving portion defines a void for receiving the foot, and the strap or straps extend outward from one or more sides of the foot-receiving portion.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DETAILED DESCRIPTION

The following discussion and accompanying figures disclose various uppers for articles of footwear, the uppers (or at least portions thereof) being at least partially formed from a material produced through a flat knitting process. The uppers are disclosed in combination with footwear suitable for activities that include running and yoga. Concepts associated with the footwear and the uppers are not limited solely to footwear designed for running and yoga, but they may be applied to a wide range of athletic footwear styles, including baseball shoes, basketball shoes, cross-training shoes, cycling shoes, football shoes, tennis shoes, soccer shoes, walking shoes, and hiking boots, for example. The concepts also may be applied to footwear styles that are generally considered to be non-athletic, including dress shoes, loafers, sandals, and work boots. The concepts disclosed herein apply, therefore, to a wide variety of footwear styles. Also, aspects of this invention may be used in conjunction with other portions of a footwear structure, such as a layer within an upper member structure, an interior lining for a footwear product (such as a sock liner), a bootie member (optionally for inclusion in a footwear structure), etc.

Flat knitting, when used in example structures according to this invention, can provide various advantages. For example, flat knitting can be used to provide textile structures for use in footwear uppers of a final desired shape such that textile cutting steps can be avoided (which eliminates waste, avoids the need to finish cut edges, saves time, saves money, etc.). Flat knitted elements also can be formed directly in desired three dimensional shapes, which can help avoid the need to use additional support structures in the overall footwear construction (which also saves time, money, etc.; produces a lighter and/or more flexible product; may eliminate seams and at least some sewing, etc.; etc.). By selectively placing multiple different yarns and/or stitch patterns at multiple different locations in the overall structure during the knitting process, flat knitted products may have multiple different physical properties (e.g., different stretchability, different moisture management capabilities, etc.) at multiple different locations or zones within a single, unitary construction (e.g., different properties at different zones or locations within a single footwear structure). Additionally, flat knitting can be used to produce pockets, tunnels, or other layered structures in the final product. These and other features, aspects, and advantages of structures and methods in accordance with examples of this invention will be described in more detail below in conjunction with the various example structures illustrated in FIGS. 1-13.

General Footwear Structure

Figure 1:
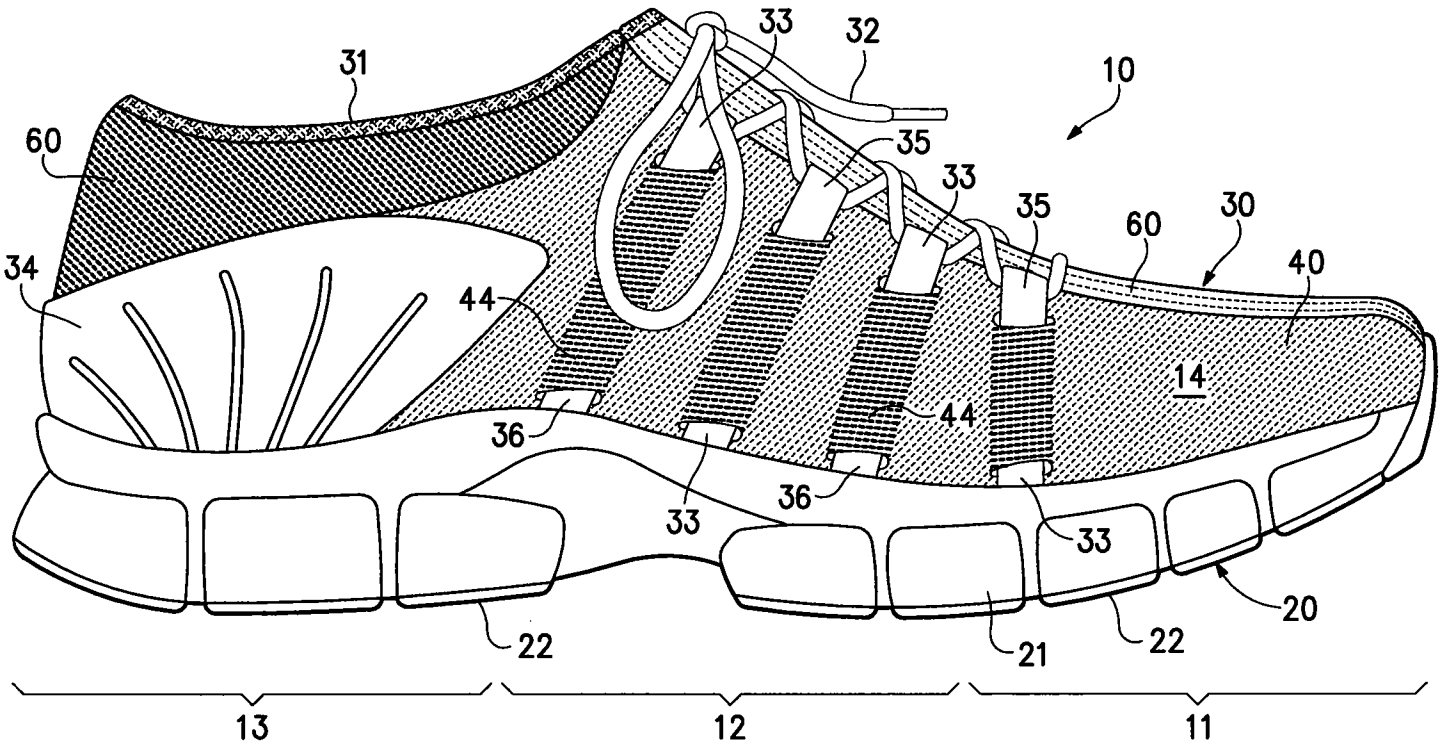
FIG. 1 is a lateral side elevational view of an article of footwear having a first upper in accordance with the invention.
Figure 2:
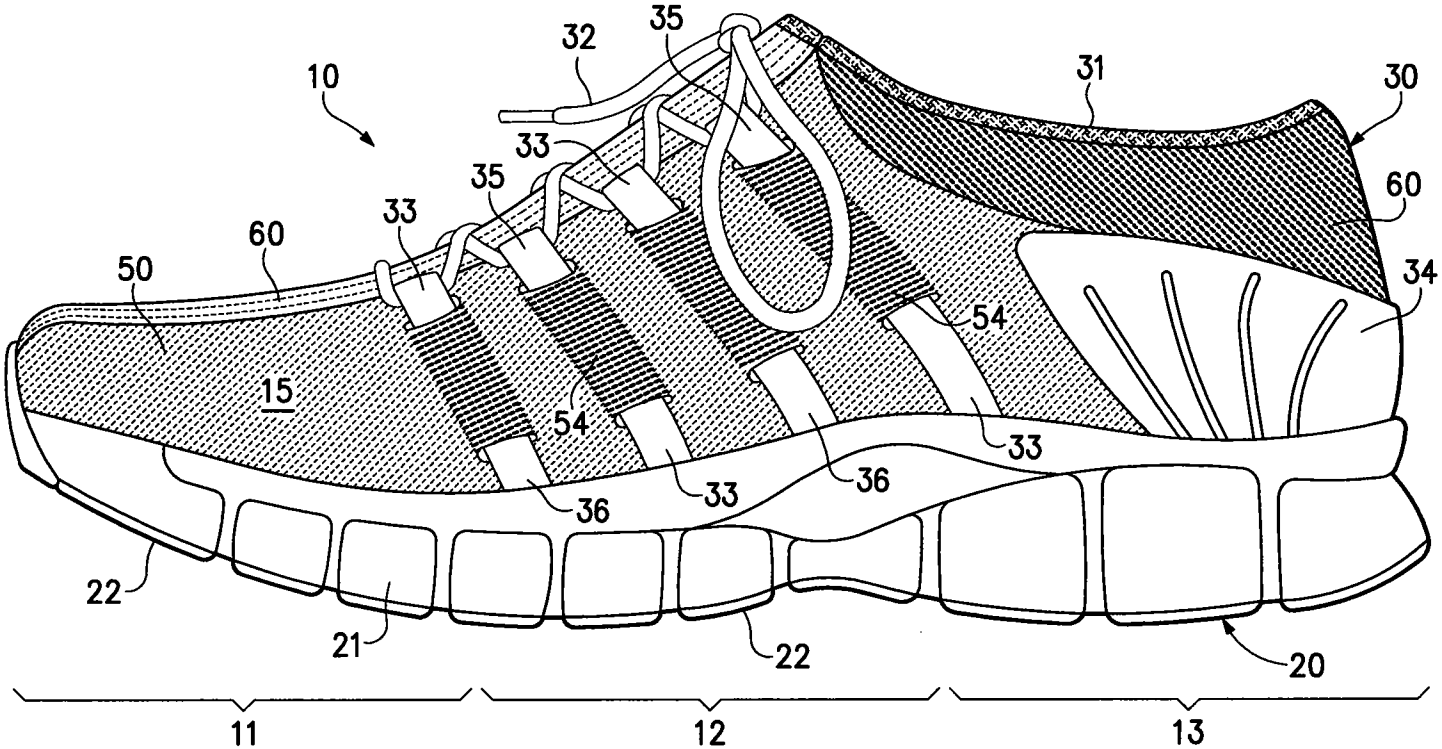
FIG. 2 is a medial side elevational view of the article of footwear.

An article of footwear 10 is depicted in FIGS. 1-4C as including a sole structure 20 and an upper 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, and individual elements thereof.

Sole structure 20 is secured to upper 30 and extends between the foot and the ground when footwear 10 is worn. In addition to providing traction, sole structure 20 may attenuate ground reaction forces when compressed between the foot and the ground during walking, running, or other ambulatory activities. As depicted in the figures, one suitable configuration for sole structure 20 includes a midsole 21, an outsole 22, and an insole 23. Midsole 21 is secured to a lower surface of upper 30 and is primarily formed from a polymer foam element (e.g., a polyurethane or ethylvinylacetate foam, phylon, phylite, etc.) that imparts the ground reaction force attenuation properties to sole structure 20. Midsole 21 may incorporate a fluid-filled bladder that supplements the ground reaction force attenuation properties. Outsole 22 is secured to a lower surface of midsole 21 and may be formed from textured rubber or other materials that impart a relatively high degree of wear resistance and/or traction properties. Insole 23 is located within upper 30 and is positioned to extend under a lower surface of the foot. Although this configuration for sole structure 20 provides a suitable example for a sole structure that may be used in connection with upper 30, a variety of other conventional or nonconventional configurations for sole structure 20 may also be utilized without departing from this invention.

Upper 30 defines a void within footwear 10 for receiving and securing the foot relative to sole structure 20. More particularly, the void is shaped to accommodate a foot and extends along the lateral side of the foot, along the medial side of the foot, over the foot, and under the foot. Access to the void is provided by an ankle opening 31 located in at least heel region 13. A lace 32 extends through various lace elements 33 and permits the wearer to modify dimensions of upper 30, thereby accommodating feet with varying proportions. Lace 32 also permits the wearer to loosen upper 30 and facilitate removal of the foot from the void. Lace elements 33 in this example footwear structure 10 are formed from a flexible material, and each has a pair of loops 35 formed on opposite ends of a central section 36, with loops 35 having a configuration that receives lace 32. In addition, upper 30 includes a heel counter 34 that extends around heel region 13 and limits movement of the heel. A wide variety of other lace engaging elements and/or other footwear securing systems may be provided, if desired.

Textile Elements

The void in this example footwear structure 10 is primarily defined by a lateral textile element 40, a medial textile element 50, and a central textile element 60. Lateral textile element 40 forms portions of upper 30 corresponding with lateral side 14. Medial textile element 50 forms portions of upper 30 corresponding with medial side 15. In addition, central textile element 60 forms portions of upper 30 extending under the foot, over forward portions of the foot, and around the heel of the foot. Textile elements 40, 50, and 60 extend around the foot and are the primary elements of footwear 10 that make contact with the foot or a sock worn over the foot. In general, and as described in greater detail below, upper 30 is substantially assembled by joining edges of textile elements 40, 50, and 60 to impart a general shape of the void. In addition, assembling upper 30 in this example structure 10 involves incorporating lace 32, lace elements 33, and heel counter 34 into footwear 10.

Textile elements 40, 50, and 60 are depicted as forming portions of both an exterior surface and an opposite interior surface of footwear 10. In further configurations, textile elements 40, 50, and 60 may form only the exterior surface or only the interior surface (e.g., as an interior liner or bootie for the footwear structure). Textile elements 40, 50, and 60 may also be located between other footwear elements so as to form non-visible or non-exposed portions of footwear 10. In addition, textile elements 40, 50, and 60 are depicted as extending through each of regions 11-13, but they may be limited to a smaller portion of footwear 10.

Figure 5:
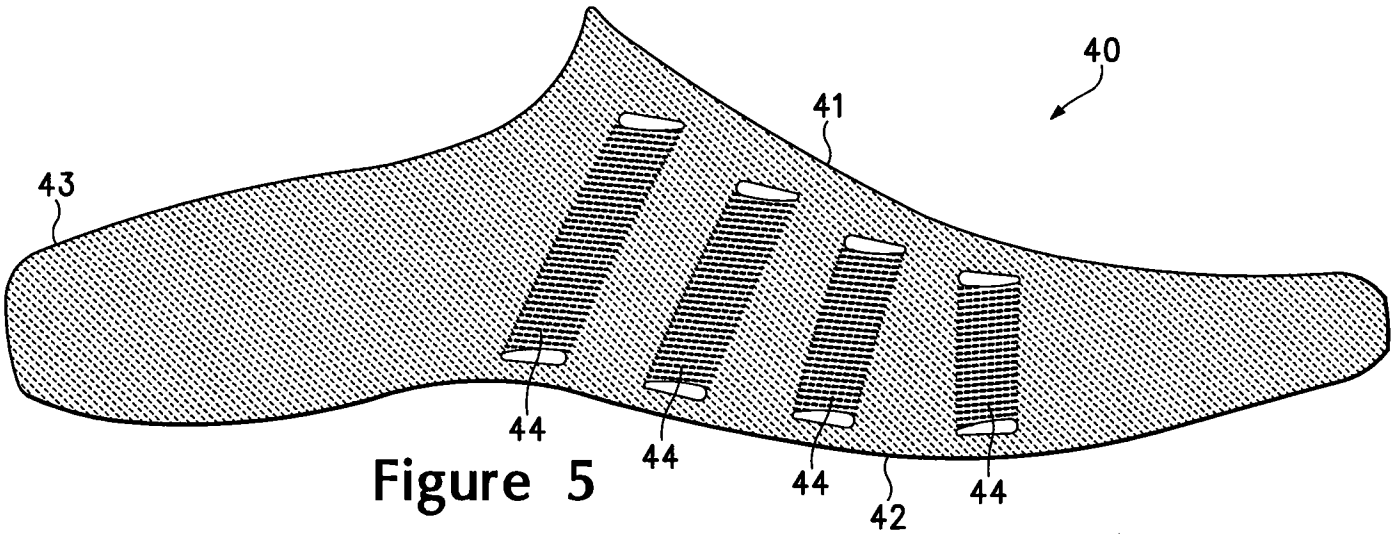
FIG. 5 is a plan view of a lateral textile element of the first upper.

Lateral textile element 40 is depicted individually in FIG. 5 and is formed of unitary (i.e., one-piece) construction through a flat knitting process. That is, a flat knitting process is utilized to mechanically manipulate one or more yarns in a manner that forms an upper edge 41, a lower edge 42, a rear edge 43, and four channels 44 in lateral textile element 40. As depicted in the cross-section of FIG. 4B, channels 44 are formed from two at least partially coextensive layers of the material forming lateral textile element 40, and the two layers are formed of unitary (i.e., one piece) construction through the flat knitting process. When viewed from the side of footwear 10, as in FIG. 1, channels 44 are oriented in a substantially vertical direction or are angled with respect to a vertical direction.

Figure 6:
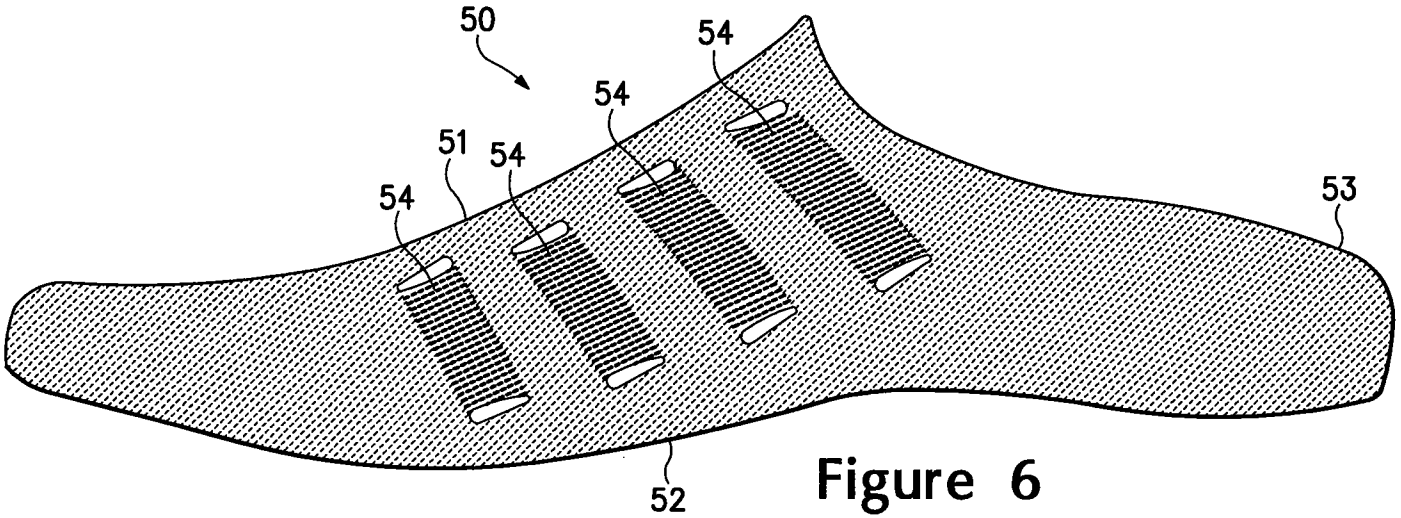
FIG. 6 is a plan view of a medial textile element of the first upper.

Medial textile element 50 is depicted individually in FIG. 6 and is similar in shape and configuration to lateral textile element 40. Accordingly, medial textile element 50 is formed of unitary (i.e., one-piece) construction through a flat knitting process. That is, a flat knitting process is utilized to mechanically manipulate one or more yarns in a manner that forms an upper edge 51, a lower edge 52, a rear edge 53, and four channels 54 in medial textile element 50. As depicted in the cross-section of FIG. 4B, channels 54 are formed from two at least partially coextensive layers of the material forming medial textile element 50, and the two layers are formed of unitary (i.e., one piece) construction through the flat knitting process. When viewed from the side of footwear 10, as in FIG. 2, channels 54 are oriented in a substantially vertical direction or are angled with respect to the vertical direction. Channels 54 are, therefore, similar in configuration and orientation to channels 44 of lateral textile element 40.

Figure 3:
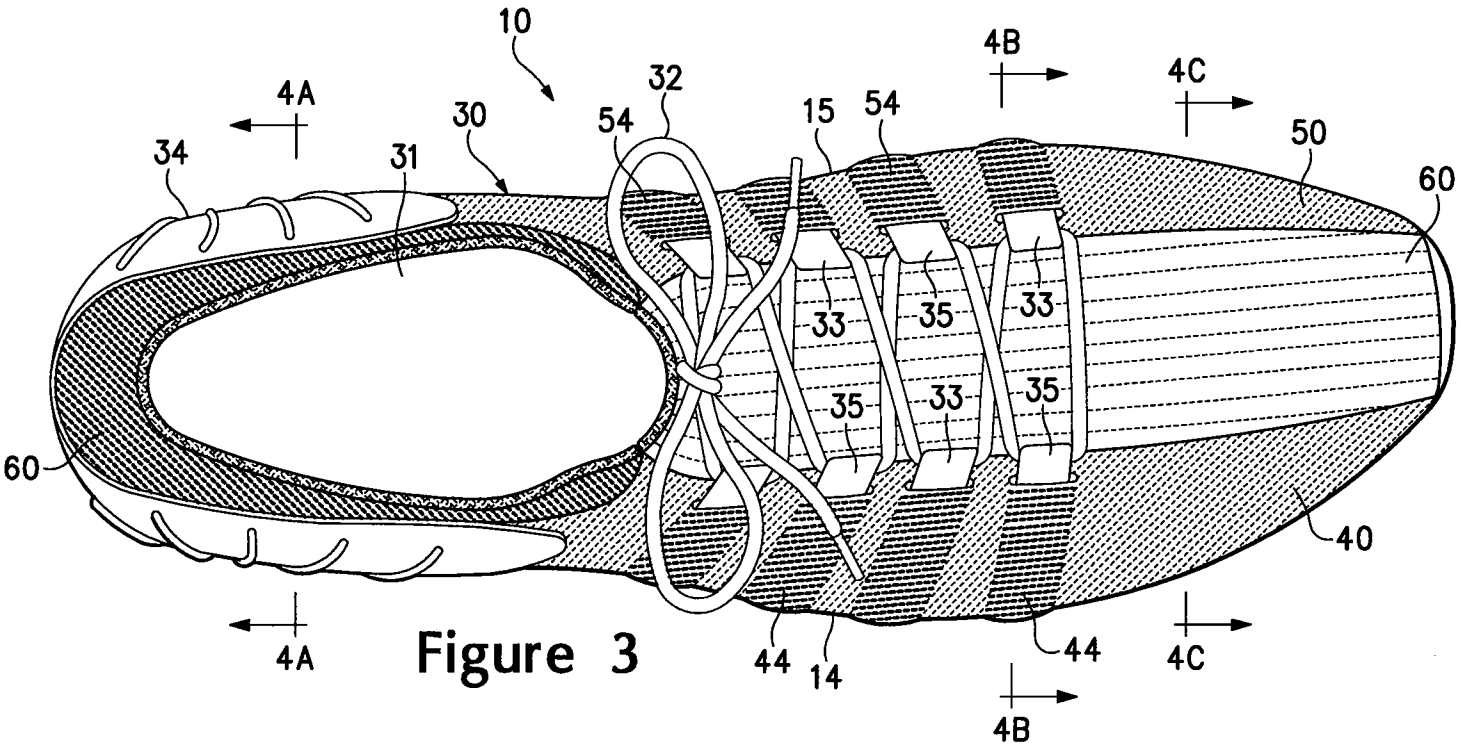
FIG. 3 is top plan view of the article of footwear.
Figure 4A:
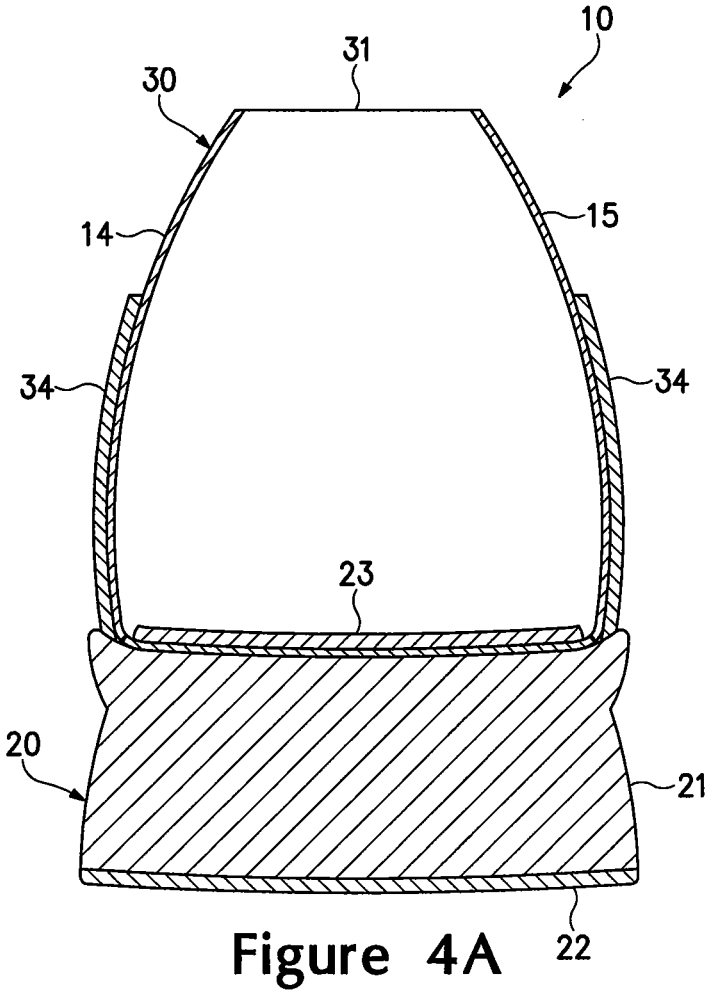
FIGS. 4A-4C are cross-sectional views of the article of footwear, as defined by section lines 4A-4C in FIG. 3.
Figure 4B:
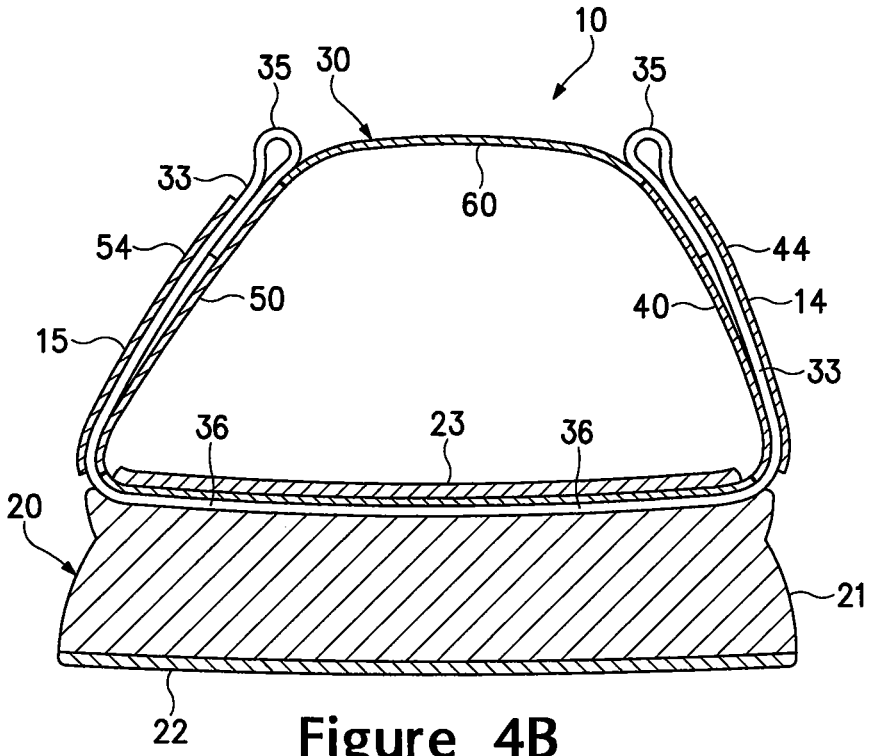
Figure 4C:
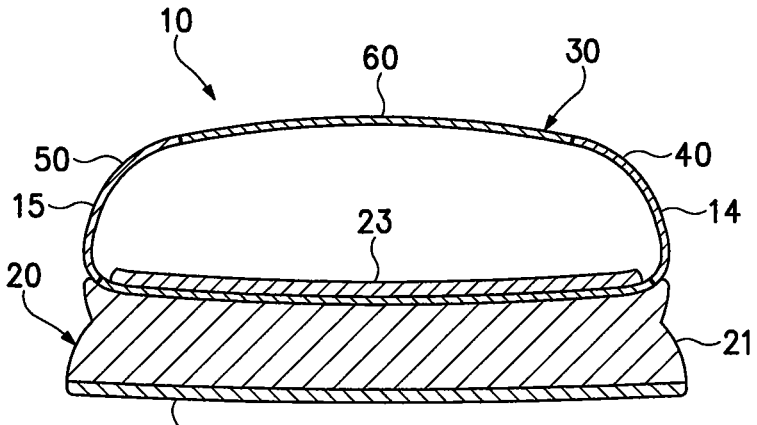
Figure 7:
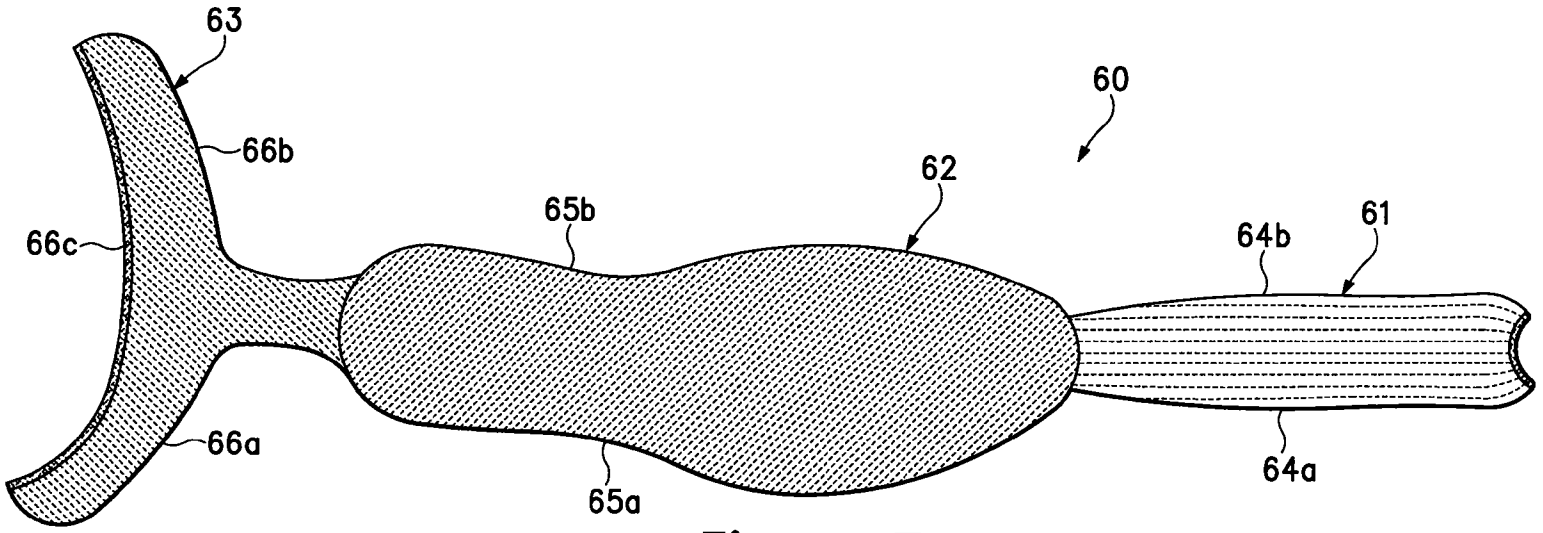
FIG. 7 is a plan view of a central textile element of the first upper.

Central textile element 60 is depicted individually in FIG. 7 and includes a forward portion 61, a center portion 62, and a rearward portion 63 formed of unitary (i.e., one piece) construction. Forward portion 61 is primarily located in a throat area of footwear 10 (i.e., under lace 32) and has an elongate configuration defined by a lateral edge 64*a* and a medial edge 64*b*. As depicted in FIG. 3, and as described in greater detail below, at least a portion of lateral edge 64*a* is joined to lateral textile element 40 and at least a portion of medial edge 64*b* is joined to medial textile element 50. Center portion 62 is primarily located adjacent sole structure 20 (i.e., in an area extending under the foot) to form a lower portion of the void within upper 30. Center portion 62 has a shape that approximates a shape of the foot and is defined by a lateral edge 65*a* and a medial edge 65*b*. As described in greater detail below, lateral edge 65*a* is joined to lateral textile element 40 and medial edge 65*b* is joined to medial textile element 50. Rearward portion 63 is primarily located in heel region 13 and has a generally Y-shaped configuration defined by a lateral edge 66*a*, a medial edge 66*b*, and an ankle edge 66*c*. As described in greater detail below, lateral edge 66*a* is joined to lateral textile element 40, medial edge 66*b* is joined to medial textile element 50, and ankle edge 66*c* forms a portion of an upper edge of ankle opening 31.

Flat Knitting and Yarn

Each of textile elements 40, 50, and 60 may be formed through a flat knitting process. In general, flat knitting is a method for producing knitted material in which the material is turned periodically (i.e., the material is knitted from alternating sides). The two sides (otherwise referred to as "faces") of the material are conventionally designated as the "right side" (i.e., the side that faces outwards, towards the viewer) and the "wrong side" (i.e., the side that faces inwards, away from the viewer). Flat knitting may be contrasted with circular knitting, in which the fabric is always knitted from the same side. Various circular knitting techniques are known, for example, narrow tube circular knitting and wide tube circular knitting. More specific examples of circular knitting techniques are described in U.S. Published Patent Publication No. 2005/0193592, which publication is entirely incorporated herein by reference. In contrast with circular knitting, flat knitting may be more complicated because the same stitch (as seen from the right side) is produced by two different movements when knitted from the right and wrong sides. Accordingly, a knit stitch (as seen from the right side) may be produced by a knit stitch on the right side or by a purl stitch on the wrong side. In flat knitting, the fabric is usually turned after every row. Although flat knitting provides a suitable manner for forming textile elements 40, 50, and 60, other types of knitting may also be utilized, including wide tube circular knitting, narrow tube circular knit jacquard, single knit circular knit jacquard, double knit circular knit jacquard, and warp knit jacquard, for example.

An advantage of flat knitting over various other types of knitting is that the flat knitting process may be utilized to form generally three-dimensional structures or structures wherein layers of material overlap each other (i.e., are at least partially coextensive) to form loops or other overlapping configurations, as with channels 44 and 54. More particularly, the flat knitting process may make structures wherein layers are joined to each other such that opposite sides of one layer are formed of unitary construction with the other layer, as with channels 44 and 54. In addition, flat knitting may be utilized to form areas with different types of stitches and areas with different types of yarns. For example, forward portion 61 of central element 60 is depicted as having a ribbed configuration that stretches to a different degree than the non-ribbed configurations of center portion 62 and rearward portion 63. Moreover, textile elements 40 and 50 may be formed from a less stretchable type of stitch than forward portion 61, and the yarn selected for textile elements 40 and 50 may be more wear-resistant than the yarn selected for forward portion 61. As another example, the knit/yarn combination utilized for rearward portion 63 may be selected to impart stretch and recovery to ankle opening 31. Accordingly, the flat knitting process may be utilized to form a generally three-dimensional or overlapping structure having areas with different properties that are produced from combinations of different types of stitches and different types of yarns.

The flat knitting process may also be utilized to form elements with defined shapes that do not need to be cut from a larger textile element. For example, each of textile elements 40, 50, and 60 may be knitted to have the respective shapes depicted in FIGS. 5-7 without cutting textile elements 40, 50, and 60 from larger textile elements. Unlike textile elements cut from a larger textile element, therefore, the edges of textile elements 40, 50, and 60 do not need to be finished to prevent unraveling. Also this feature reduces waste and saves time and money in the manufacturing process.

The yarn forming textile elements 40, 50, and 60 may include cotton and wool fibers, natural filaments such as silk, and synthetic filaments that include rayon, nylon, polyester, and acrylic. Other materials also may be used without departing from this invention. The yarn may be a monofilament yarn or a plurality of individual filaments. The yarn may also be formed of separate filaments formed of different materials, or the yarn may be formed of filaments that are each formed of two or more different materials. Similar concepts also apply to yarns formed from fibers. In order to provide the stretch and recovery properties to upper 30, and particularly textile elements 40, 50, and 60, a yarn that incorporates an elastane fiber may be utilized. Elastane fibers are available from E.I. duPont de Nemours Company under the LYCRA® trademark. Such fibers may have the configuration of covered LYCRA®, wherein the fiber includes a LYCRA® core that is surrounded by a nylon sheath. One suitable yarn, for example, includes a 70 denier elastane core that is covered with nylon having a 2 ply, 80 denier, 92 filament structure. Other fibers or filaments exhibiting elastic properties may also be utilized.

The characteristics of the yarn selected for textile elements 40, 50, and 60 depend primarily upon the materials that form the various filaments and fibers. Cotton, for example, provides a soft hand, natural aesthetics, and biodegradability. Elastane fibers, as discussed above, provide substantial stretch and recoverability. Rayon provides drape and moisture absorption. Wool also provides high moisture absorption, in addition to insulating properties. Polytetrafluoroethylene coatings may provide a low friction contact between the textile and the skin. Nylon is a durable and abrasion-resistant material with high strength, and polyester is a hydrophobic material that dries quickly and also provides relatively high durability. The flat filaments of nylon/polyester may provide luster whereas textured filaments may provide bulk and a matte luster. Accordingly, the materials comprising the yarn may be selected to impart a variety of physical properties to textile elements 40, 50, and 60, and the physical properties may include, for example, strength, stretch, support, stiffness, recovery, fit, and form.

Assembly Process

Figure 8A:
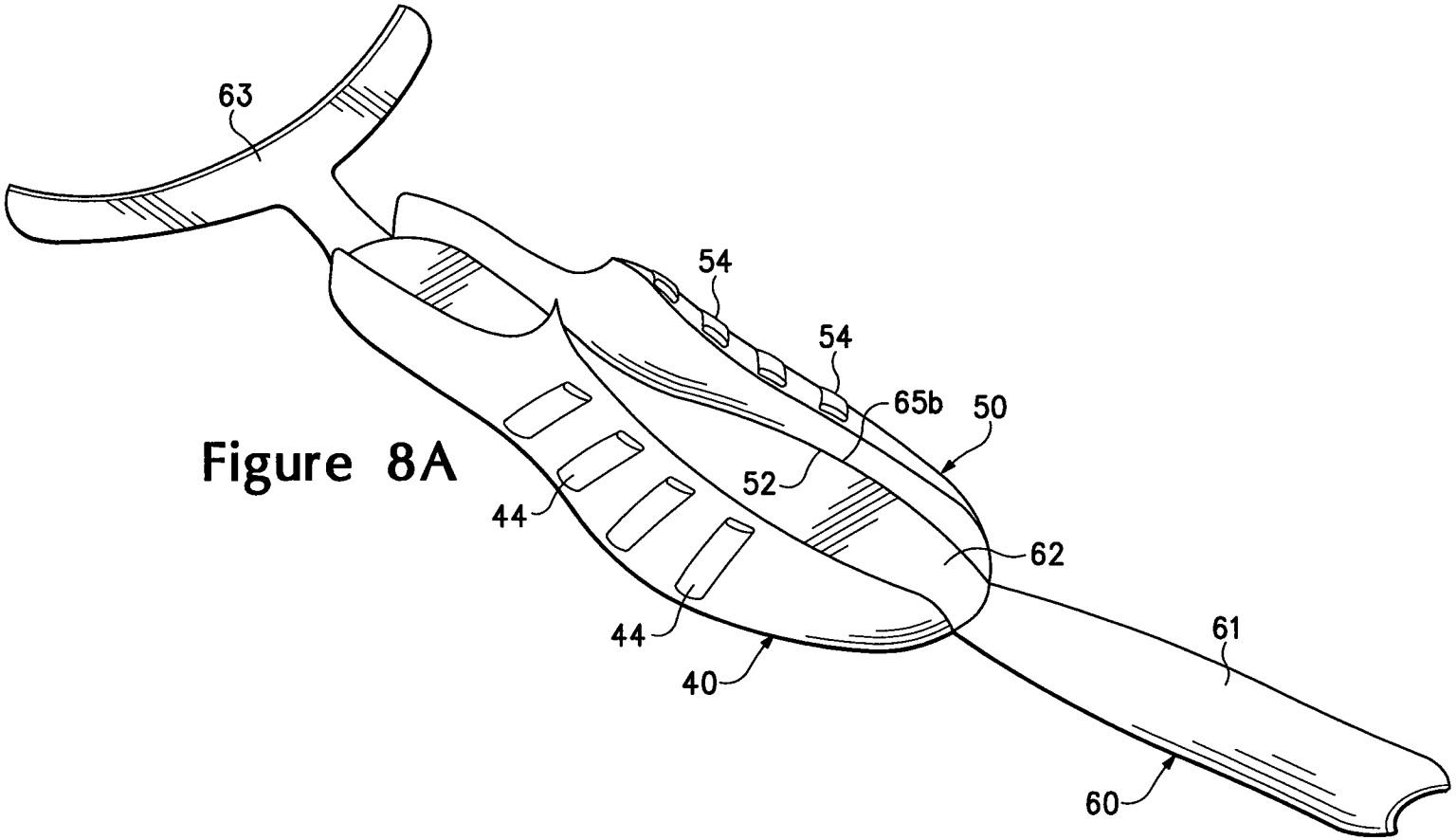
FIG. 8A is a perspective view depicting a first step in assembling the article of footwear.

A suitable assembly process for footwear 10 is generally depicted in FIGS. 8A-8E. The order of the various steps outlined below is discussed as an example of the manner in which footwear 10 may be assembled. One skilled in the relevant art will recognize, however, that a different order may also be utilized for assembling footwear 10. With reference to FIG. 8A, each of textile elements 40 and 50 are depicted as being stitched or otherwise joined to central textile element 60. More particularly, lower edge 42 of lateral textile element 40 is stitched to lateral edge 65*a* of center portion 62, and lower edge 52 of medial textile element 50 is stitched to medial edge 65*b* of center portion 62. A variety of stitch types may be utilized to join edges 42, 52, 65*a*, and 65*b* in the manner discussed above. For example, edges 42, 52, 65*a*, and 65*b* may abut each other or overlap each other once the stitching is applied. In addition to stitching, edges 42, 52, 65*a*, and 65*b* may be joined to each other with an adhesive or with a heat bonding operation. Accordingly, a variety of methods may be utilized to join textile elements 40, 50, and 60. Furthermore, one skilled in the relevant art will recognize that a last having the general shape of the foot may be utilized in joining textile elements 40, 50, and 60 to form upper 30.

Figure 8B:
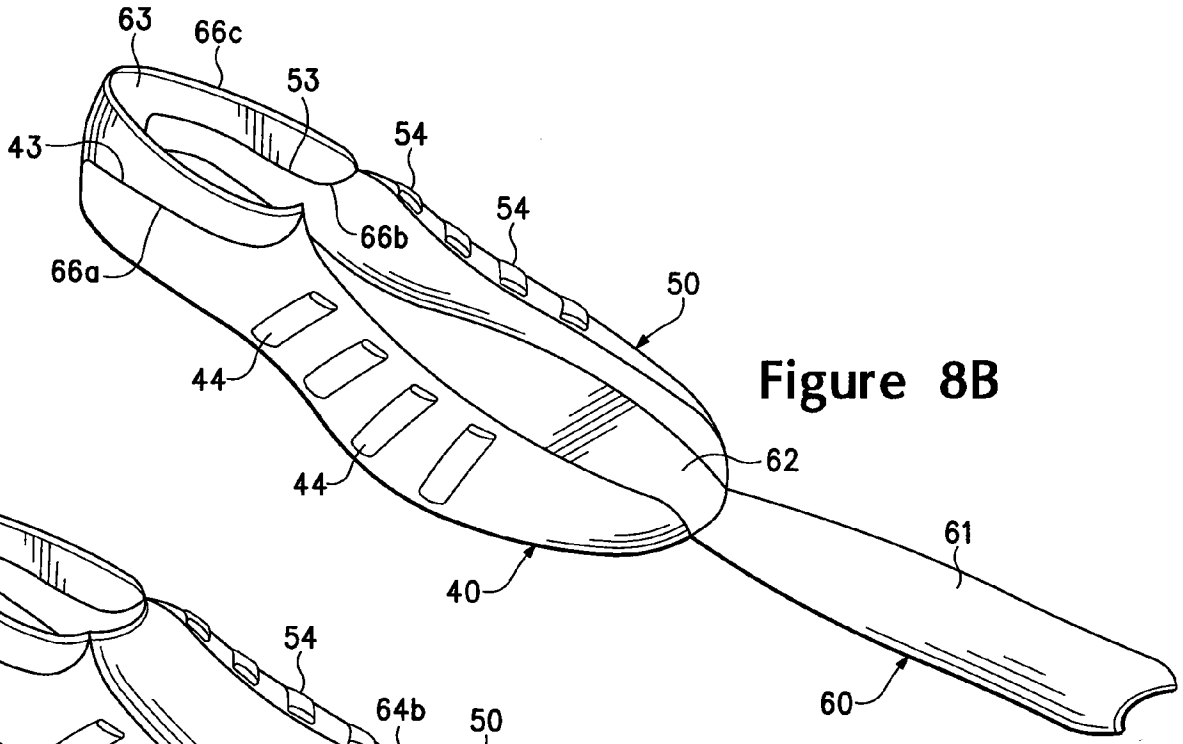
FIG. 8B is a perspective view depicting a second step in assembling the article of footwear.
Figure 8C:
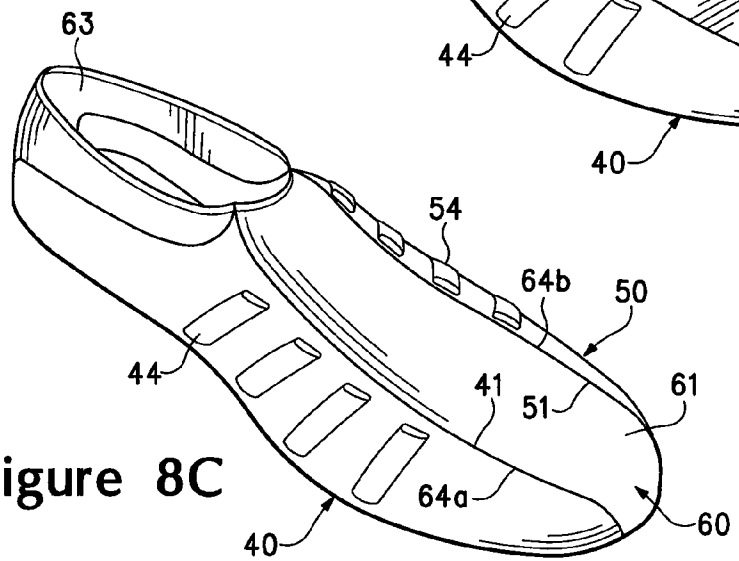
FIG. 8C is a perspective view depicting a third step in assembling the article of footwear.

Once lower portions of textile elements 40 and 50 are joined to center portion 62, textile elements 40 and 50 are joined to rearward portion 63, as depicted in FIG. 8B. More particularly, rear edge 43 of lateral textile element 40 is stitched to lateral edge 66*a* of rearward portion 63, and rear edge 53 of medial textile element 50 is stitched to medial edge 66*b* of rearward portion 63. With reference to FIG. 8C, the assembly process continues by joining textile elements 40 and 50 to forward portion 61. More particularly, upper edge 41 of lateral textile element 40 is stitched to lateral edge 64*a* of forward portion 61, and upper edge 51 of medial textile element 50 is stitched to medial edge 64*b* of forward portion 61.

Figure 8D:
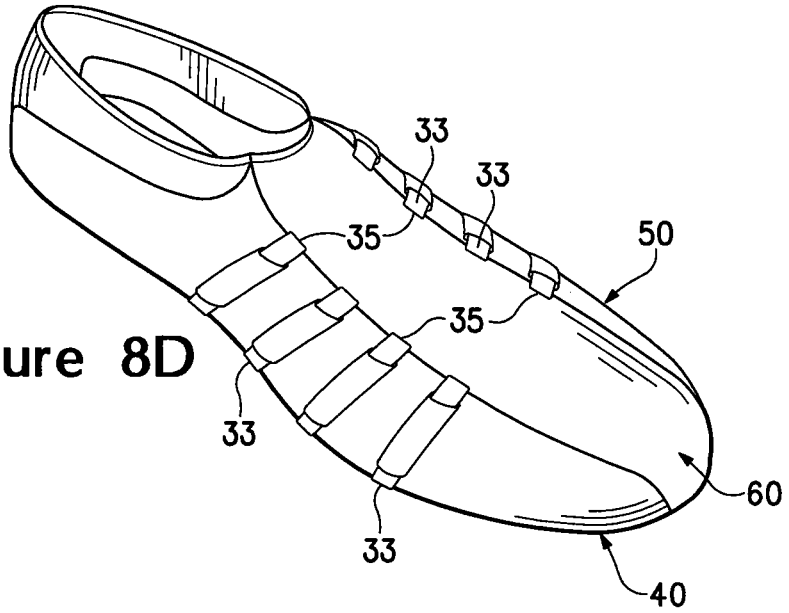
FIG. 8D is a perspective view depicting a fourth step in assembling the article of footwear.
Figure 8E:
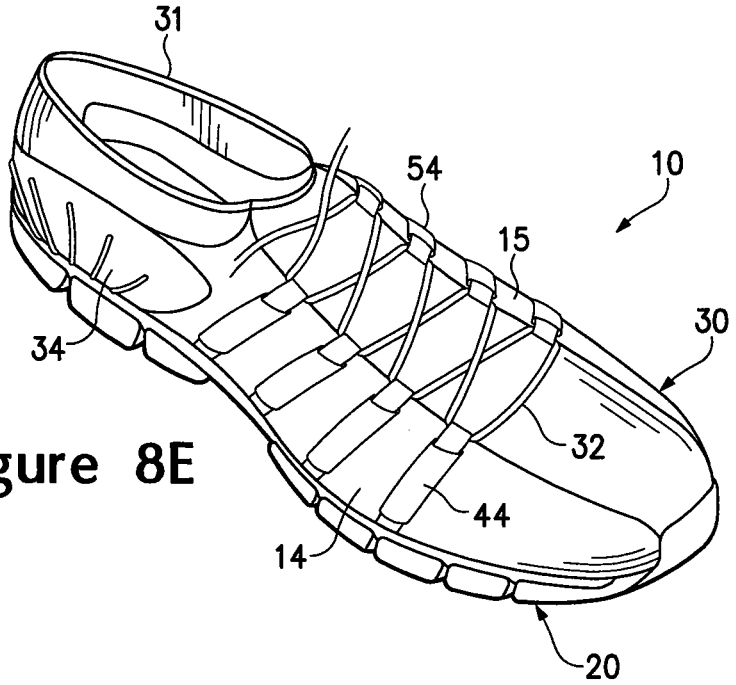
FIG. 8E is a perspective view depicting a fifth step in assembling the article of footwear.

At this point in the assembly process, textile elements 40, 50, and 60 are joined to each other to form an interior void shaped to receive the foot. The various other elements of footwear 10 may now be added. With reference to FIG. 8D, lace elements 33 are positioned to extend through channels 44 and 54 and also extend under center portion 62 of central textile element 60. Each of loops 35 are positioned to extend outward from upper portions of channels 44 and 54, and central section 36 of lace elements 33 is positioned under and on the exterior of central textile element 60. As the final steps in this example assembly process, as depicted in FIG. 8E, lace 32 is threaded through lace elements 33, heel counter 34 is adhesively-bonded or otherwise secured to an exterior of upper 30 in heel region 13, and sole structure 20 is adhesively-bonded or otherwise secured to a lower area of upper 30.

Additional Configurations

Figure 9A:
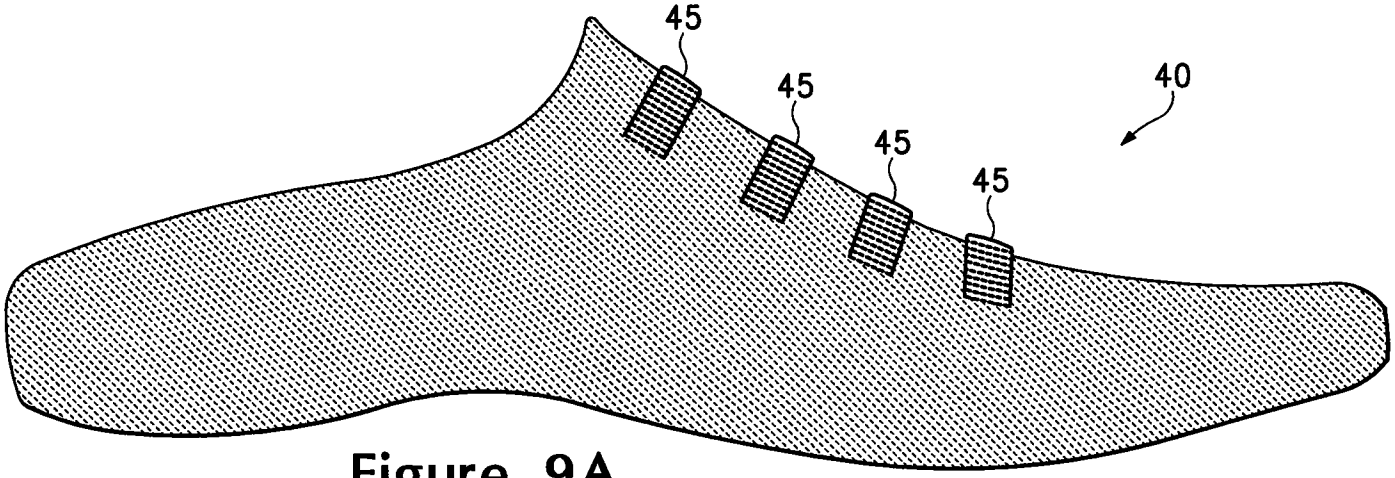
FIG. 9A is a plan view of another configuration for the lateral textile element.

Footwear 10 provides an example of a suitable configuration of an article of footwear having an upper at least partially formed from a flat knit material structure. With reference to FIG. 9A, another configuration for lateral textile element 40 is depicted as having various lace loops 45 in place of channels 44 and lace elements 33. As discussed above, the flat knitting process may be utilized to form generally three-dimensional structures wherein layers of material overlap each other (i.e., are at least partially coextensive) to form loops or other overlapping configurations, as with channels 44 and 54. Lace loops 45 may be used in place of lace elements 33 to receive portions of lace 32. Although not necessary, lace elements 33 may be formed from a substantially inextensible material. In order to provide lace loops 45 with similar properties, the yarns and stitch selected for lace loops 45 may impart a substantially non-stretch configuration to upper 30 in the area of lace loops 45.

Figure 9B:
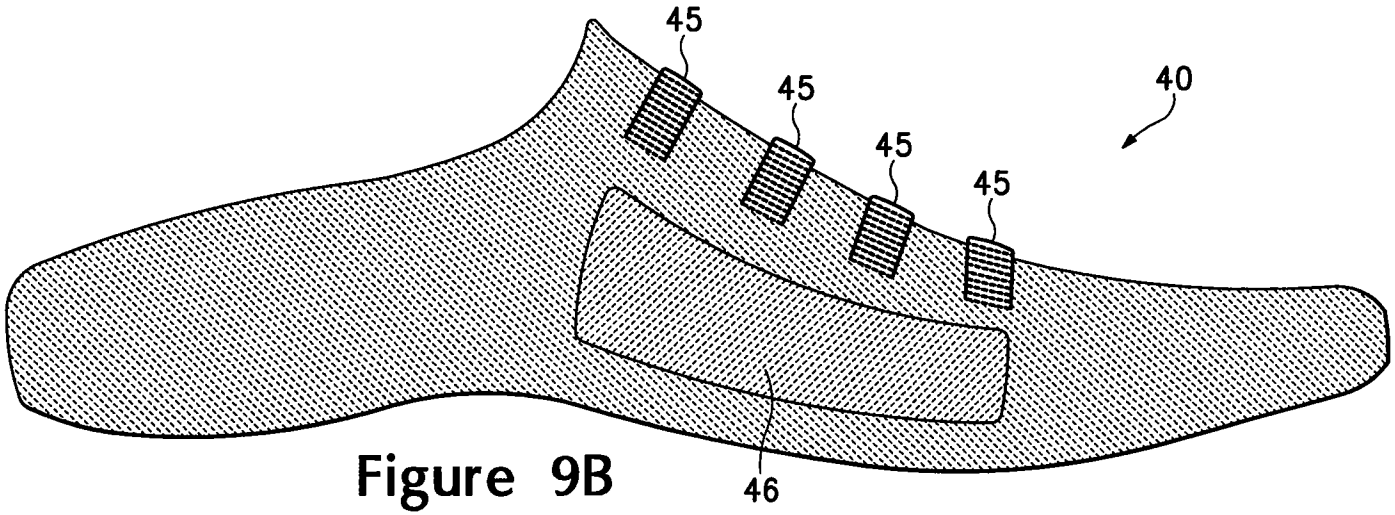
FIG. 9B is a plan view of yet another configuration for the lateral textile element.

Yet another configuration for lateral textile element 40 is depicted in FIG. 9B as having a pocket 46 in place of channels 44 and lace elements 33. Pocket 46 has an upper opening and is otherwise closed to permit small items (e.g., a key, identification, or change) to be secured within footwear 10. As with channels 44 and lace loops 45, pocket 46 is formed through the flat knitting process as a unitary construction with the textile element 40. If desired, a flap or other closure element may be provided to help secure items within the pocket 46 (optionally, the flap may be formed as part of the textile element 40 in the flat knitting process (e.g., as a unitary, one-piece structure therewith).

Figure 10A:
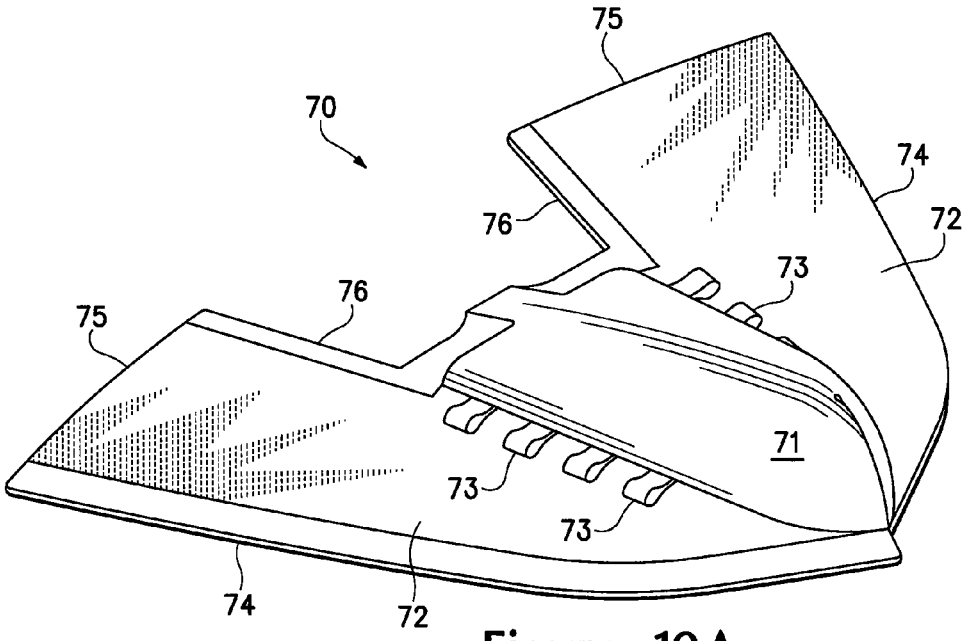
FIG. 10A is a perspective view of a textile element of a second upper in accordance with the invention.
Figure 10B:
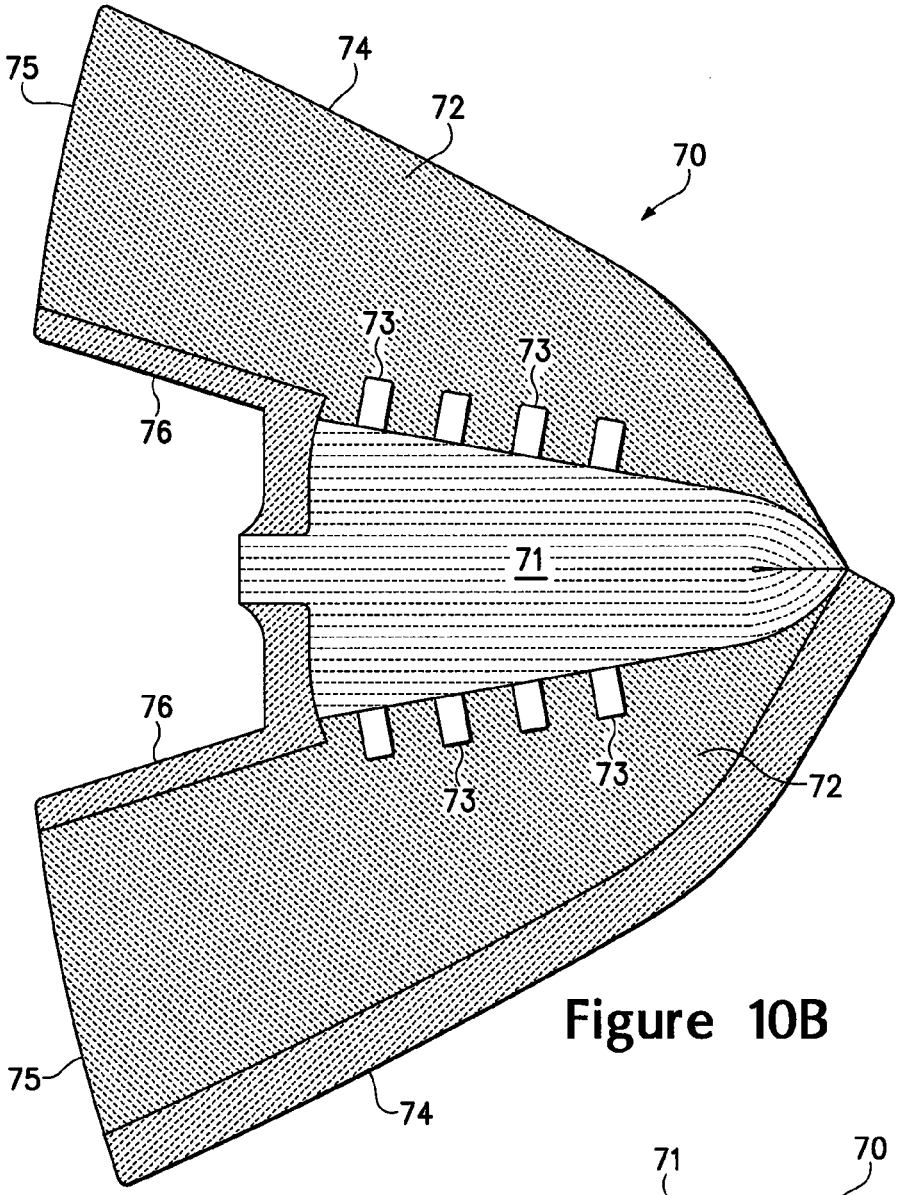
FIG. 10B is a top plan view of the textile element of the second upper.
Figure 10C:
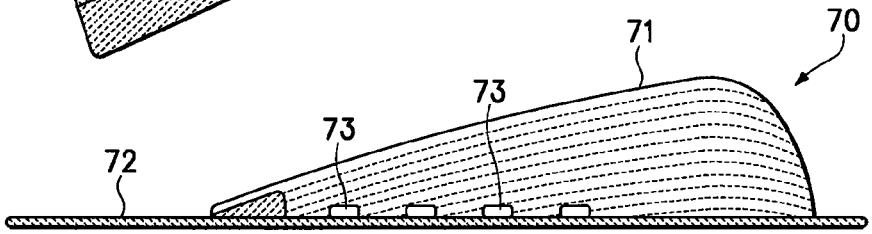
FIG. 10C is a side elevational view of the textile element of the second upper.

As another example of a three-dimensional structure formed through a flat knitting process, an upper 70 is depicted in FIGS. 10A-10C. Upper 70 includes a central portion 71, a pair of side portions 72, and eight lace loops 73. Side portions 72 each include a side edge 74, a rear edge 75, and a central edge 76. When assembled into an article of footwear, central portion 71 extends over the foot, and side portions 72 wrap under the foot. More particularly, side edges 74 are joined to each other (e.g., with stitching) to form a seam that extends under the foot and along a longitudinal length of the foot. In addition, rear edges 75 are joined to each other (e.g., with stitching) to form a seam that extends upward along the heel. In this configuration, central edge 76 may define an opening that permits the foot to enter and exit a void within upper 70. A lace may also extend through lace loops 73 to provide adjustability.

Whereas side portions 72 are relatively flat in configuration, central portion 71 has a domed shape formed through the flat knitting process. That is, the flat knitting process forms central portion 71 to have a three-dimensional structure that is shaped to extend over the foot. In comparison with side portions 72, which have a non-ribbed type of knit, central portion 71 may be ribbed. In addition to different knit types, different areas may also incorporate different yarns to further vary the properties of upper 70. In addition to providing a three-dimensional structure, therefore, the flat knitting process may be utilized to impart different knit types and yarns to different areas of upper 70, thereby varying the properties of upper 70 in the different areas.

Figure 11A:
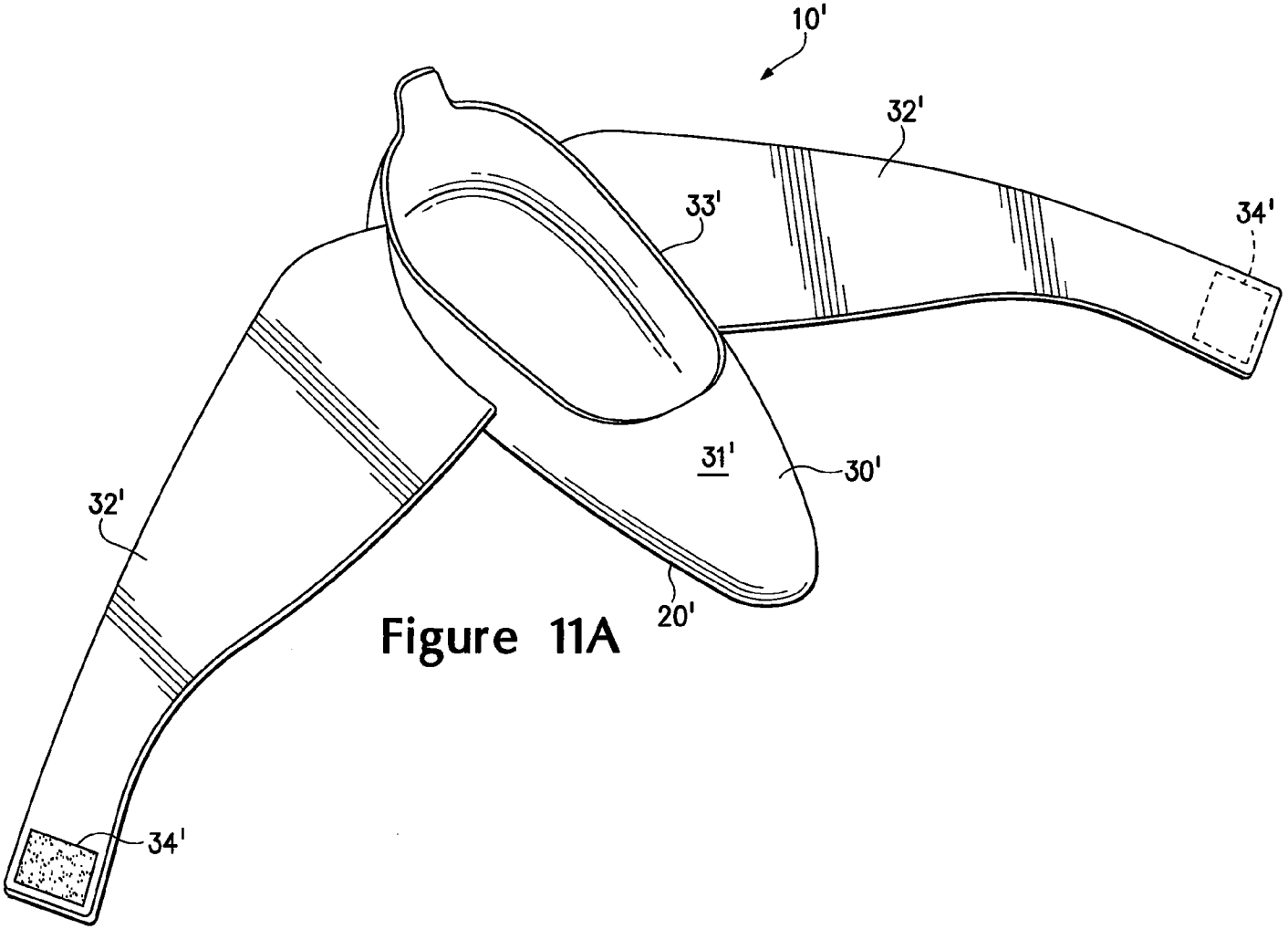
FIG. 11A is a perspective view of an article of footwear having a third upper in accordance with the invention.
Figure 11B:
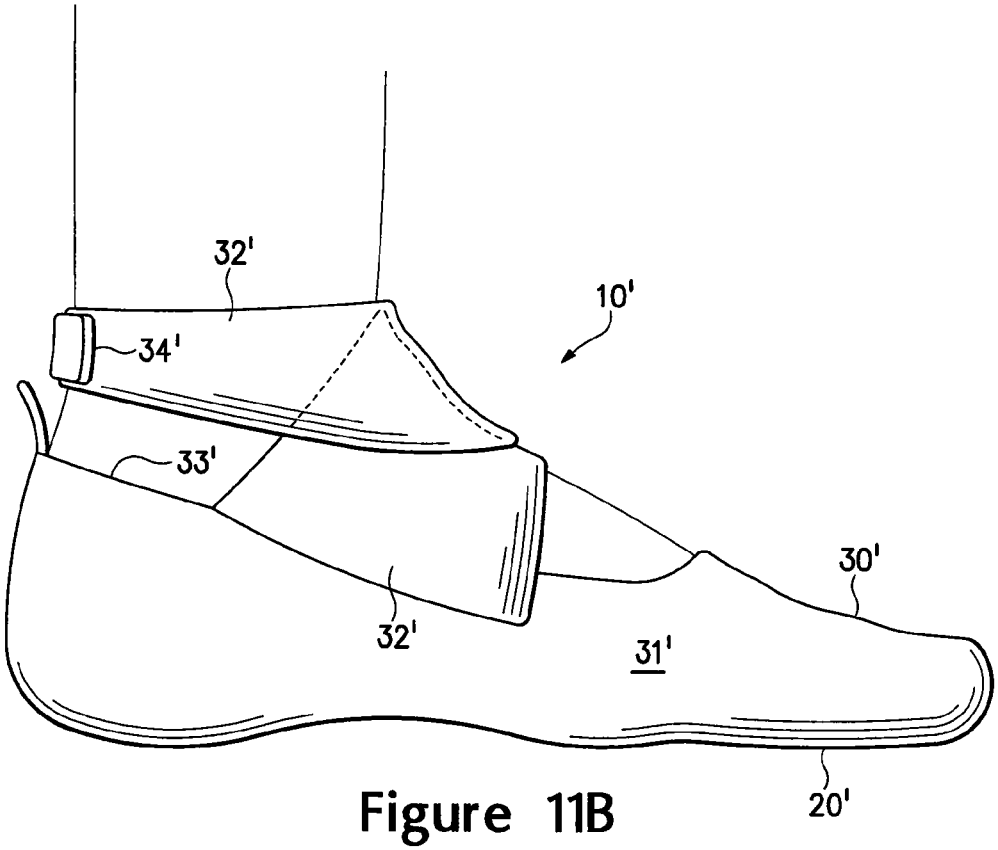
FIG. 11B is a side elevational view of the third upper in combination with a foot.

Another article of footwear 10' is depicted in FIGS. 11A and 11B as including a sole structure 20' and an upper 30'. Whereas footwear 10 includes sole structure 20 that is separate from and attached to upper 30, sole structure 20' of this example is a lower surface of a textile material that forms upper 30'. Accordingly, footwear 10' may be used for activities such as yoga where a minimal sole is acceptable. In other configurations, sole structure 20' may include polymer foam or rubber elements that impart force attenuation and wear resistance. A separate sole structure may be provided for use with upper 30', if desired.

Upper 30' includes a foot-receiving portion 31' and a pair of straps 32' that extend outward from sides of foot-receiving portion 31'. Foot-receiving portion 31' has the general configuration of a sock that is formed of unitary (i.e., one piece) construction by the flat knitting process. Foot-receiving portion 31' is, therefore, a textile element shaped to extend around the foot, and foot-receiving portion 31' has an opening 33' for inserting and removing the foot from upper 30'. Straps 32' are each formed of unitary (i.e., one piece) construction with foot-receiving portion 31' and are joined with foot-receiving portion 31' proximal opening 33'. As with foot-receiving portion 31', straps 32' are formed through the flat knitting process. Each of straps 32' in this example structure are tapered from the area where straps 32' are joined with foot-receiving portion 31' to an end portion of straps 32'. That is, the end portions of straps 32' have a lesser width than the portions of straps 32' that are adjacent opening 33'. Straps 32' may each be formed from a single layer of textile material, or each of straps 32' may have a tubular configuration that is effectively formed from two layers of the textile material.

Straps 32' are utilized to secure footwear 10' to the foot. As such, straps 32' may have a length that ranges, for example, between three inches and twenty-four inches, depending upon the size and intended use of footwear 10'. As depicted, however, straps 32' are approximately six inches in length. Each of straps 32' has an end portion and a fastener 34' that is located at the end portion. Fastener 34' is depicted as corresponding portions of a hook-and-loop fastener, such as VELCRO®, but they may also be snaps, buttons, or other desired fasteners. With reference to FIG. 11B, straps 32' wrap around the ankle such that fastener 34' is utilized to secure the end portions of straps 32' together behind the ankle Alternately, straps 32' may be tied on the upper surface of the foot or may wrap around the foot to secure footwear 10' to the foot.

Accordingly, a variety of methods for securing footwear 10' to the foot may be utilized, depending upon the foot size and preferences of the wearer.

Whereas upper 30 is formed from three separate textile elements 40, 50, and 60 that are joined through stitching, upper 30' is formed from a single textile element formed of unitary construction. In contrast with upper 30, therefore, upper 30' is free from seams that may contact the foot during use. That is, foot-receiving portion 31' of this example structure 10' is formed to extend around the foot and does not include seams adjacent the foot. Furthermore, the seamless union of sole structure 20' and upper 30' in this example structure 10' further reduces seams adjacent the foot. Accordingly, the flat knitting process may be utilized to form a seamless footwear component that extends around the foot.

Figure 12:
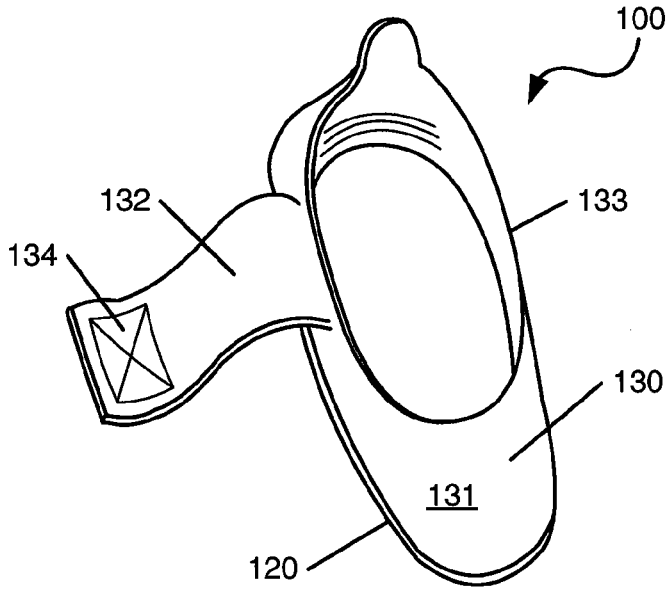
FIG. 12 is a perspective view of an article of footwear having another upper configuration in accordance with this invention.
Figure 13:
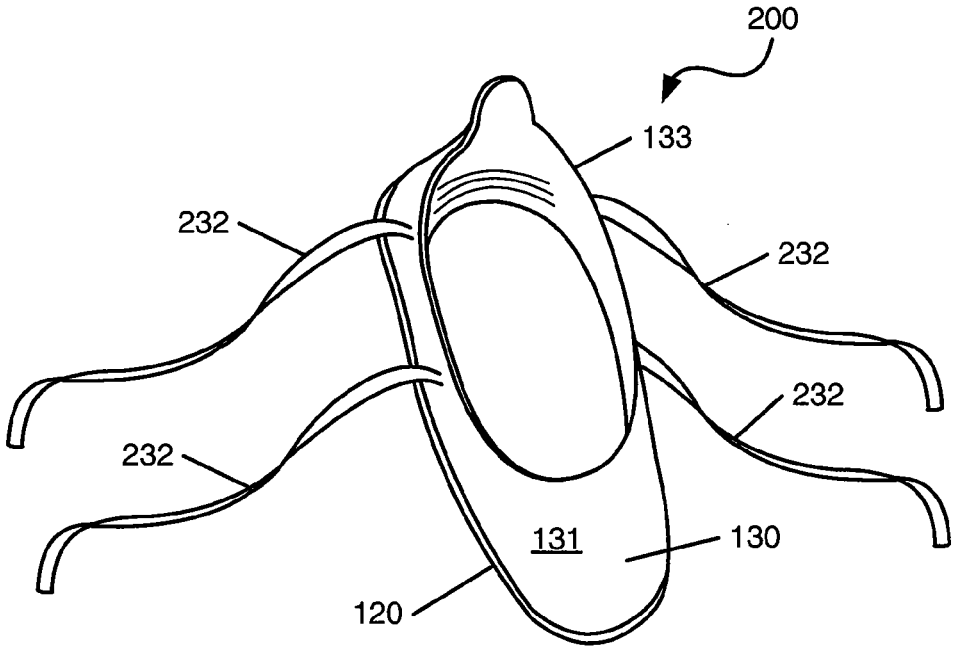
FIG. 13 is a perspective view of an article of footwear having yet another upper configuration in accordance with this invention.

FIGS. 12 and 13 illustrate additional examples of articles of footwear like the example shown in FIGS. 11A and 11B, but these additional examples have somewhat different straps and/or securing arrangements. In the example article of footwear 100 shown in FIG. 12, the article of footwear 100 includes a sole structure 120 and an upper 130. A separate sole structure 120 may be provided and attached to the upper 130, if desired, or the upper 130 and the sole structure 120 may be provided as a unitary, one-piece construction (e.g., as a flat knit yoga shoe, slipper, bootie, or the like). The upper 130 of this example structure 100 includes a foot-receiving portion 131 that defines an opening 133 through which the wearer's foot may be inserted. This example structure 100 includes a single strap 132 that extends over the wearer's foot to secure the foot in the article of footwear 100. While any desired type of securing system may be provided (e.g., buttons, snaps, hooks, buckles, etc.), in this example structure 100, one portion of a hook-and-loop fastener 134 is provided on the free end of the strap 132, and this portion of the fastener 134 secures to another portion of the hook-and-loop fastener (not shown) provided at the side of the upper 130. The strap 132 may be provided on either the lateral side or the medial side of the upper member 130 without departing from the invention. This strap 132 may be provided as a unitary, one-piece construction with the upper member 130 by a flat knitting process, e.g., in the manner described above in conjunction with the strap 32 of FIGS. 11A and 11B. If desired, the strap 132 (as well as straps 32 described above) may be constructed from a stretchable material, e.g., to enable a snug and secure fit to the wearer's foot.

FIG. 13 illustrates an example article of footwear 200 having yet another strap/securing arrangement. In this example, parts that are the same or similar to those described in conjunction with FIG. 12 will be labeled with the same reference number (and the corresponding description thereof will be omitted). Rather than a single strap, in this example, several (e.g., four in the illustrated example) long and relatively thin and flexible straps 232 are provided. If desired, the straps 232 may be sufficiently thin and/or flexible to allow the wearer to tie them together around the foot (e.g., in a bow or a knot, akin to a shoelace), to thereby secure the foot in the article of footwear 200. The straps 232 may be of sufficient length to wrap around the wearer's ankle one or more times, and optionally up the wearer's calf, e.g., in a manner similar to straps provided in conventional ballet slippers and/or Greco Roman type sandals. If desired, rather than tying, fastener elements (such as hook-and-loop fasteners, or the like) may be provided, e.g., in a manner similar to that described above in conjunction with FIGS. 11A through 12.

Straps 232 may be formed as a unitary, one piece construction with the upper member 130, e.g., during a flat knitting process, like the processes described above in conjunction with FIGS. 11A through 12. Alternatively, if desired, the straps 232 may be separate from the upper member 130 (e.g., like a lace, belt, ribbon, or other strap element), optionally extending through channels formed in the upper member 130, e.g., in a manner similar to the channels 44 and 54 described above in conjunction with FIGS. 1-8E. Other strap and/or fastener arrangements may be provided without departing from this invention.

While the footwear structures 10', 100, and 200 shown in FIGS. 11A through 13 are illustrated as ballet or yoga type footwear, the described structures and techniques may be used to provide upper members or portions thereof (e.g., liners, bootie elements, etc.) for a wide variety of different footwear products without departing from the invention.

Conclusion

As described above, a flat knitting process may be utilized to form a variety of uppers or other structures for inclusion in footwear products. An advantage of flat knitting is that generally three-dimensional structures may be formed. In addition, structures wherein layers of material overlap each other to form loops or other overlapping configurations may be formed. The flat knitting process may also be utilized to form areas with different properties, e.g., by using combinations of different types of stitches and/or different types of yarns. Accordingly, flat knitting may be utilized to shape an upper and also provide different properties to different areas of the upper.

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined by the appended claims.

That which is claimed is:

1. An article of footwear comprising:

a knitted element that includes a knitted foot-receiving portion and a first knitted strap formed of unitary construction with the foot-receiving portion, the foot-receiving portion shaped to extend around a foot and defining a void for receiving the foot, the foot-receiving portion including an opening that provides access to the void;

the foot-receiving portion including a lateral side and a medial side extending along a longitudinal direction of the article of footwear, the lateral side and the medial side each having an outward-facing exterior side surface oriented approximately perpendicular to the longitudinal direction;

the first knitted strap having a planar configuration defined by a length and a first width at a first end and a second width at a second end;

wherein the first knitted strap is joined to the foot-receiving portion at the outward-facing exterior side surface adjacent to the opening of the foot-receiving portion, the first end of the first knitted strap being formed of unitary knit construction with the foot-receiving portion throughout the extent of the first width and being oriented along the longitudinal direction of the article of footwear; and wherein the first knitted strap extends outward and away from the outward-facing exterior side surface of the foot-receiving portion on at least one of the lateral side and medial side of the foot-receiving portion.

2. The article of footwear recited in claim 1, wherein the first knitted strap extends approximately perpendicularly from the outward-facing exterior side surface of the foot-receiving portion.

3. The article of footwear recited in claim 1, wherein the first knitted strap is tapered along the length of the first knitted strap from the first end to the second end.

4. The article of footwear recited in claim 1, wherein the first width is greater than the second width.

5. The article of footwear recited in claim 1, further comprising a second knitted strap formed of unitary construction with the foot-receiving portion, wherein each of the straps includes corresponding portions of a fastener.

6. The article of footwear recited in claim 5, wherein the corresponding portions of the fasteners are located adjacent end portions of the straps.

7. An article of footwear at least partially formed from a knitted element, the knitted element comprising:

a foot-receiving portion shaped to extend around a foot and that defines a void for receiving the foot, the foot-receiving portion including an opening that provides access to the void and a lateral side and a medial side extending along a longitudinal direction of the article of footwear, the lateral side and the medial side each having an exterior side face oriented approximately perpendicular to the longitudinal direction;

a pair of straps formed of unitary construction with the foot-receiving portion, the straps having a planar configuration defined by a length and a first width at a first end and a second width at a second end, the straps being located adjacent the opening of the foot-receiving portion, and the straps joined to and extending outward from the exterior side faces of the foot-receiving portion on each of the lateral side and medial side such that the first end of the straps extends along the exterior side faces in the longitudinal direction; and a fastener system, each of the straps including corresponding portions of the fastener system.

8. The article of footwear recited in claim 7, wherein first width and the second width of the straps are configured so that the straps are tapered along the length of the straps.

9. The article of footwear recited in claim 7, wherein the first width is greater than the second width.

10. The article of footwear recited in claim 7, wherein the corresponding portions of the fastener system are located adjacent end portions of the straps.

11. An article of footwear, comprising:

a knitted element that includes a knitted foot-receiving portion and a first knitted strap formed of unitary construction with the foot-receiving portion, the foot-receiving portion configured to extend over at least a portion of a foot and defining an outward-facing exterior surface surrounding a void for receiving the foot, and a first end of the first knitted strap joined to the foot-receiving portion throughout a width of the first end of the first knitted strap at the outward-facing exterior surface along at least one of a lateral side and a medial side; and the first knitted strap extending approximately perpendicularly outward and away from the outward-facing exterior surface of the foot-receiving portion.

12. The article of footwear recited in claim 11, wherein the foot-receiving portion includes an opening that provides access to the void for receiving the foot, and the first knitted strap is located adjacent the opening of the foot-receiving portion.

13. The article of footwear recited in claim 11, wherein the first strap includes at least a portion of a fastener.

14. The article of footwear recited in claim 11, further comprising:

a second strap formed of unitary construction with the foot-receiving portion, a first end of the second strap joined to the foot-receiving portion throughout a width of the first end of the second knitted strap at the outward-facing exterior surface along at least one of the lateral side and the medial side and extending approximately perpendicularly outward and away from the outward-facing exterior surface of the foot-receiving portion.

15. The article of footwear recited in claim 14, wherein the first strap and the second strap extend outward from the same outward-facing lateral or medial side exterior surface of the foot-receiving portion.

16. The article of footwear recited in claim 14, wherein the first strap extends outward from the outward-facing lateral side exterior surface of the foot-receiving portion and the second strap extends outward from the outward-facing medial side exterior surface.

17. The article of footwear recited in claim 11, further comprising:

a second strap formed of unitary construction with the foot-receiving portion, the second strap extending outward from the same outward-facing exterior surface of the foot-receiving portion as the first strap;

a third strap formed of unitary construction with the foot-receiving portion, the third strap extending outward from an opposite outward-facing exterior surface of the foot-receiving portion as the first strap; and a fourth strap formed of unitary construction with the foot-receiving portion, the fourth strap extending outward from the same opposite outward-facing exterior surface of the foot-receiving portion as the third strap.

* * * * *